United States Patent [19]

Möltner et al.

[11] Patent Number: 4,848,185

[45] Date of Patent: Jul. 18, 1989

[54] TRANSMISSION FOR DRIVING THE ROLLS OF A ROLLING LINE

[75] Inventors: Hermann Möltner, Grevenbroich; Helmut Holthoff, Düsseldorf, both of Fed. Rep. of Germany

[73] Assignee: Kocks Technik GmbH & Co., Hilden, Fed. Rep. of Germany

[21] Appl. No.: 33,006

[22] Filed: Mar. 31, 1987

[30] Foreign Application Priority Data

May 2, 1986 [DE] Fed. Rep. of Germany ..... 3614803

[51] Int. Cl.[4] ..... F16H 37/06; F16H 57/02; F16H 3/44; B65G 13/06

[52] U.S. Cl. ..... 74/674; 74/606 R; 74/793; 198/791

[58] Field of Search ..... 198/789, 791, 577, 784; 74/665 A, 665 B, 665 C, 665 D, 675, 801, 793, 674, 606 R

[56] References Cited

U.S. PATENT DOCUMENTS

| | | | |
|---|---|---|---|
| 1,594,396 | 8/1926 | Weston | 74/675 |
| 2,757,556 | 8/1956 | Uebing | 74/675 |
| 2,782,902 | 2/1957 | Sloane | 74/675 |
| 3,222,954 | 12/1965 | Wuertz | 198/791 X |
| 3,600,977 | 8/1971 | Bogie | 198/791 X |
| 4,008,629 | 2/1977 | Hoepfl et al. | 74/801 X |
| 4,359,914 | 11/1982 | Meisel Jr. | 74/801 X |
| 4,385,530 | 5/1983 | Holthoff | 74/675 |
| 4,392,396 | 7/1983 | Sato et al. | 74/801 X |
| 4,406,340 | 9/1983 | Gennaux | 74/801 X |
| 4,587,861 | 5/1986 | Morishita | 74/801 X |

FOREIGN PATENT DOCUMENTS

| | | | |
|---|---|---|---|
| 0014666 | 8/1980 | European Pat. Off. | 198/789 |
| 1022158 | 1/1958 | Fed. Rep. of Germany | 198/791 |
| 2629039 | 1/1978 | Fed. Rep. of Germany | 198/789 |
| 2732926 | 2/1979 | Fed. Rep. of Germany | 198/789 |
| 0352402 | 7/1931 | United Kingdom | 198/789 |

*Primary Examiner*—Leslie A. Braun
*Assistant Examiner*—Harold F. Macris
*Attorney, Agent, or Firm*—Buchanan Ingersoll; Alvin E. Ring; Paul A. Beck

[57] ABSTRACT

In a transmission for driving the rolls of a rolling line having a number of rolling stands disposed one after another, a respective planetary transmission stage is provided at several output shaft (20) and forms the output rotational speed from a basic rotational speed and an additional rotational speed. The gear wheels (2,23) of the gear wheel transmission trains transmitting the basic and additional rotational speeds are mounted on stationary bearing bushes (3, 26) which project into the hub regions of the gear wheels (2, 23) and are secured in bores or on flange facings of the load-bearing walls (5, 6) of the transmission housing (1). Only one of the gear wheel transmision trains is disposed between the load-bearing walls of the transmision housing, while the other is disposed on the outside stands. This permits the transmission to be of lighter construction and allows greater gear ratios in the gear wheel transmission trains and a smaller distance between the output shafts (20).

7 Claims, 1 Drawing Sheet

TRANSMISSION FOR DRIVING THE ROLLS OF A ROLLING LINE

The invention relates to a transmission for driving the rolls of a rolling line having a number of rolling stands disposed one after the other in the direction of rolling.

In known transmissions, a respective planetary transmission stage is provided at several or all the output shafts of the transmission and forms the output rotational speed from a basic rotational speed and an additional rotational speed. Separate gear wheel transmission trains are provided for transmitting the basic and additional rotational speeds to the planetary transmission stages. The planetary transmission stages are located in the gears of one of the transmission trains.

In one known transmission of this type U.S. Pat. No. 4,385,530, the planetary transmission stages are disposed in the spur wheel bearing bushes of both the basic and the additional rotational speed transmission trains between the load-bearing outer walls of the transmission housing, which is in conventionally closed form. The load-bearing walls of the housing are those walls which absorb the bearing forces from the gear wheels and shafts.

In this known type of construction, the gear wheels of both gear wheel transmission trains are mounted by way of rolling bearings on the central carrier shafts of the planetary transmission stages, said central carrier shafts serving both as planet wheel carriers and as output shafts. As a result, large forces exerted by the teeth are transmitted to the carrier shafts, so that these shafts are subjected to a high degree of bending stress. At the same time, the relatively large distance between the bearings in the load-bearing walls of the housing has a negative effect. In order to contain any bending of the carrier shafts resulting from this within narrow limits, so that the gear teeth can intermesh with precision, these carrier shafts must be sufficiently resistant to bending, that is, they must have a relatively large outer diameter. Consequently, the minimum gear wheel diameter of the gear wheel transmission trains is relatively large, which increases the distance between the output shafts and thereby the distance between the rolling stands to an undesirable extent and limits the possible gear ratios in the gear wheel transmission trains noticeably. This is of particular importance for the gear wheel transmission train of the additional rotational speeds. Furthermore, in order to carry out assembly, this known type of construction requires the transmission housing to have two horizontal parting joints, which makes production more expensive.

It is an object of the invention to further develop and improve the above-described known transmission, and in particular to provide a transmission which is simpler and easier to assemble.

The present invention consists of a transmission for driving the rolls of a rolling line having a number of rolling stands disposed one after another in the direction of rolling, comprising a housing having load-bearing walls, output shafts journalled at least indirectly in the load-bearing walls, a respective planetary transmission stage at several or all of the output shafts for forming an output rotational speed from a basic rotational speed and an additional rotational speed, separate gear wheel transmission trains being provided for transmitting the basic and additional rotational speeds to the planetary transmission stages, in whose bearing sleeves the planetary transmission stages are located, one only of said gear wheel transmission trains being situated between the load-bearing walls and the other gear wheel transmission train being situated on the outside of the load-bearing wall of the housing remote from the output shafts, the gear wheels of both gear wheel transmission trains being mounted on stationary bearing bushes which project into the central regions of the gear wheels and which are secured in bores or flange facings of the load-bearing walls of the housing, the planetary transmission stages being located in the gear wheels of a first of the transmission trains.

The bearing bushes absorb the stresses which result, in particular from the forces exerted by the gear teeth, and transmit them directly to the load-bearing walls of the transmission housing without stressing any other components. This is particularly advantageous in rolling lines which have a relatively large number of rolling stands, such as, for example, stretch-reducing rolling lines for tubes. In such rolling lines, the forces exerted by the gear teeth in the region of the drive motors can attain particularly high values because the drive power for a large number of rolling stands is fed in at one point and distributed therefrom.

By journalling the gear wheels of the gear wheel transmission trains as in the invention, the internal parts of the planetary transmission stages are kept free of any stresses resulting from the forces exerted by the teeth of the gear wheel transmission trains. This in turn allows the diameters of all the parts of all the planetary transmission stages to be made smaller, as they are no longer subjected to high levels of bending strain from the gear wheel transmission trains. As a result, it is possible to keep the spacing between the output shafts, and hence between the rolling stands, as small as desired. Above all, however, the gear wheels of the transmission trains may be given a smaller diameter, such that it is possible to achieve a greater step-up ratio in the gear wheel transmission trains, which is particularly advantageous for the gear wheel transmission trains transmitting the additional rotational speeds.

Furthermore, journalling the gear wheels of the gear wheel transmission trains as in the invention allows the use of a transmission housing without parting joints, which makes production considerably more simple and less expensive. In addition, bending of the planetary transmission stages is hence avoided, which allows the wheels to run satisfactorily with a minimum of wear. Furthermore, the planetary transmission stages can be disassembled, particularly the sun and planet wheels, and the sun wheel shafts and planet wheel carriers can be removed without also having to take out the relatively large, heavy gear wheels of the gear wheel transmission trains.

It is also particularly advantageous to dispose only one gear wheel transmission train respectively between the load-bearing walls of the transmission housing because this considerably reduces the distance between the bearing and hence the bending strain on the gear wheels and bearing bushes. The arrangement of the second gear wheel transmission train, preferably the one for the additional rotational speeds, on the outside on the load-bearing wall of the housing remote from the rolling stands has, in addition to producing a short distance between the bearings and a narrow transmission housing, the considerable advantage that the gear wheels, which are rotating at a particularly high rotational speed, are easily accessible. These gear wheels can simply be covered by an oil-tight hood which is easily removable. Of the planetary transmission stages, only the sun wheel shafts in the form of quill shafts project into this region outside the load-bearing transmission housing walls, which shafts have only a small torque to transmit because they rotate at a high rotational speed due to the large gear ratios of the planetary transmission stages. Consequently, the diameter of the quill shafts is small. For this reason, and because the planetary wheel carriers of the planetary transmission stages do not project into this region outside the transmission housing, the gear wheels of the gear wheel transmission trains disposed on the outside can have much smaller diameters than was possible in the known type of construction. It is thus possible to achieve much greater gear ratios in the region of this gear wheel transmission train, and this, for example, considerably increases the range of controlling the degree of stretch in a stretch-reducing rolling line for tubes.

In one preferred embodiment of the invention, the bearing bushes secured in bores in the load-bearing walls of the housing are held by means of conical clamping sleeves. Following assembly, such conical clamping sleeves allow axial displacement of the bearing bushes in the bores of the load-bearing walls of the housing in order to adjust the desired bearing play. Once this has been adjusted, said conical clamping sleeves permit the bearing bushes to be connected to the load-bearing housing walls in a rigid manner free from play in order to maintain the adjusted bearing play.

The invention is further described by way of example, with reference to the accompanying drawings, in which.

Figures 1, 2, 3:
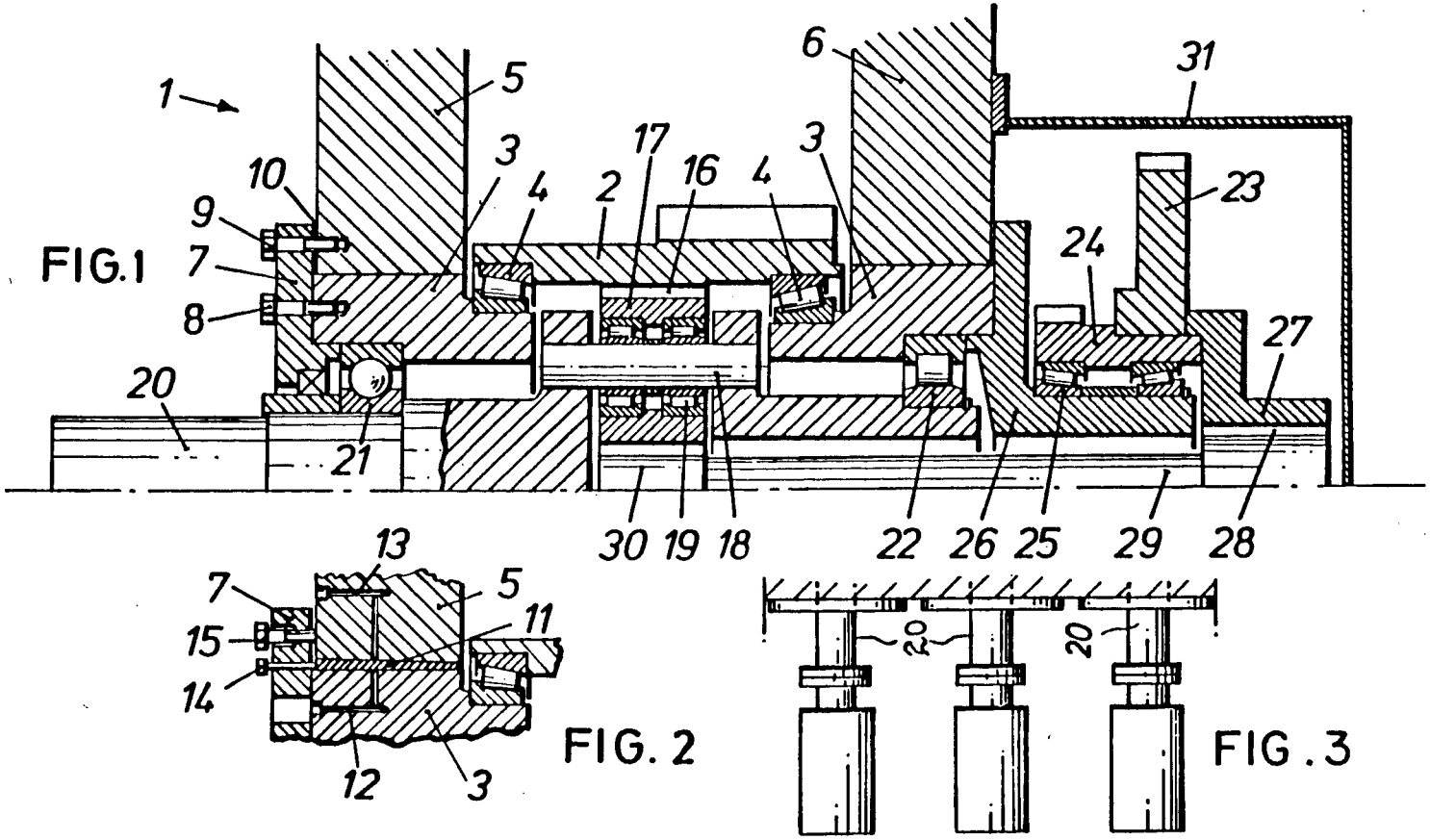
FIG. 1 is a cross sectional view of a drive transmission for a rolling line, in accordance with the invention.
FIG. 2 is a fragmentary sectional view of a modification.
FIG. 3 is a fragmentary view of a number of rolls in a rolling line.

Referring to FIG. 1, a gear wheel transmission train is disposed in a transmission housing 1, only one gear wheel 2 being shown in the drawing. The other gear wheels of this gear wheel transmission train follow in a direction perpendicular to the plane of drawing, and are thus hidden by the gear wheel 2. All the gear wheels 2 of this gear wheel transmission train are journalled in the same way by means of rolling bearings 4 externally on bearing bushes 3. The bearing bushes 3 are inserted in the axial direction in bores in two load-bearing walls 5 and 6 of the housing 1 and are secured therein once the bearing play of the rolling bearings 4 has been adjusted by a corresponding axial displacement of the bearing bushes 3.

The drawing shows two embodiments for adjusting the bearing play or securing the bearing bushes 3 in the housing walls 5 and 6. In FIG. 1, a cover 7 is used, which is firmly screwed to the bearing bush 3 by means of screws 8 distributed about the periphery. Further screws 9 which are uniformly distributed about the periphery at a larger pitch circle, are used to screw the cover 7 to the housing wall 5. An annular shim 10 in a particular thickness is disposed between the cover 7 and the housing wall 5 to ensure that the cover 7 and the bearing bush 3 take up a particular axial position to produce the desired bearing play.

A further possibility is illustrated in FIG. 2. In this case, a conical clamping sleeve 11 is disposed between the bearing bush and the housing wall 5. Using pressure oil bores 12 and 13, oil is forced between the outer or inner surface of the conical clamping sleeve 11 and the housing wall 5 or the bearing bush 3 respectively, such that it is possible to displace the bearing bush 3 and the conical clamping sleeve 11 in the bore in the housing wall 5. This displacement is effected using jack screws 14 and 15, several of which are disposed on each of two pitch circles. Two screws 14, screwed into a thread in the cover 7, press the conical clamping sleeve 11 into its bore. Two other screws (not shown) on the same pitch circle, which are screwed into an internal thread in the conical clamping sleeve 11 on the end face and guided in a through bore in the cover 7, can pull back the conical clamping sleeve 11. The same principle is applied to the screws 15 which displace the bearing bushes axially.

The gear wheel 2 of the gear wheel transmission train is at the same time the outer rim of the planetary transmission stage and, for this purpose is provided with internal teeth 16. The planetary wheels 17 are journalled on planetary wheel axles using rolling bearings 19. The planetary wheel carrier is a shaft 20 which is also the output shaft and is coupled by a coupling (not shown) to a rolling stand (not shown). In the region of the load-bearing walls 5 and 6 of the housing, the output shaft 20 is mounted in rolling bearings 21 and 22, the bearing 21 being a fixed bearing, and the bearing 22 an axially displaceable floating bearing. In the embodiment shown, the bearings 21 and 22 are received within the bearing bushes 3.

The drawing again only shows one gear wheel 23 of the second gear wheel transmission train, with associated toothed hub 24. The large difference in the pitch diameters of the gear wheel 23 and the hub 24 clearly illustrates the large gear ratio which is possible with this gear wheel transmission train. The gear wheel 23, which is rigidly connected to the hub 24, is mounted using rolling bearings 25 on a bearing bush 26 which is disposed on the outside on the load-bearing wall 6 of the housing remote from the rolling stands (not shown). The bearing bush 26 also transmits the stresses from the second gear wheel transmission train directly to the load-bearing wall 6 of the housing, without these affecting any parts of the planetary transmission stage. The bearing bush 26 can be secured in the same way as the bearing bush 3 already described above.

A sleeve 27, which is rigidly connected to the gear wheel 23 and the hub 24, has internal splines 28 which mesh with the external splines of a quill shaft 29. It would also be possible to use other known transmission means for rigidly connecting the sleeve 27 to the quill shaft 29. The other end of the quill shaft 29 has a sun wheel 30 which meshes with the planet wheels 17. If the transmission according to the invention is used as a drive for a stretch-reducing rolling line, it is recommended to feed in the basic rotational speed by way of the gear wheels 2 and the additional rotational speed by way of the gear wheels 23, 24 and to couple the output shaft 20 to the rolling stands.

FIG. 3 shows a fragmentary view of a number of output shafts 20 attached to rolls in a rolling line.

The gear wheels 23 and toothed hub 24 are protected by a thin-walled covering hood 31 which absorbs only negligible forces. It ensures above all that no lubricating oil is sprayed out and that operating personnel are protected from accidents.

We claim:

1. A transmission for driving the rolls of a rolling line having a number of rolling stands disposed one after another in the direction of rolling, comprising a housing having load-bearing walls, output shafts journalled at least indirectly in the load-bearing walls, a respective bearing sleeve and planetary transmission stage at several or all of the output shafts for forming an output rotational speed from a basic rotational speed and an additional rotational speed, separate transmission trains of gear wheels being provided for transmitting the basic and additional rotational speeds to the planetary transmission stages in whose bearing sleeves the planetary transmission stages are located, one only of said gear wheel transmission trains being situated between two of the load-bearing walls and another gear wheel transmission train being situated in the outside of the load-bearing wall most remote from the output shafts, the gear wheels of both transmission trains being mounted on stationary bearing bushes, which project into the central regions of the gear wheels and which are secured in bores or flange facings of the load-bearing walls of the housing, the planetary transmission stages being located in the gear wheels of a first of the transmission trains.

2. A transmission as claimed in claim 1, in which the bearing bushes are secured in bores in the load-bearing walls of the housing by means of conical clamping sleeves.

3. A transmission as claimed in claim 1 or 2, in which one of the transmission trains provides the basic rotational speed and is disposed between said two load-bearing walls of the housing.

4. A transmission as claimed in claim 1 or 2, in which one of the transmission trains provides the additional rotational speed and is disposed between said two load-bearing walls of the housing.

5. A transmission as claimed in claim 1 or 2 in which each planetary transmission stage has a sun wheel connected indirectly to the respective gear wheel of one of the transmission trains by means of a quill shaft.

6. A transmission as claimed in claim 3 in which each planetary transmission stage has a sun wheel connected indirectly to the respective gear wheel of one of the transmission trains by means of a quill shaft.

7. A transmission as claimed in claim 1 including two load-bearing walls.

* * * * *